United States Patent [19]

Lim

[11] Patent Number: 4,781,277

[45] Date of Patent: Nov. 1, 1988

[54] NAPPY OR DIAPER CHANGING BAG

[76] Inventor: Hooi H. Lim, Post Office Box 408, Kogarah, New South Wales 2217, Australia

[21] Appl. No.: 86,150

[22] PCT Filed: Sep. 5, 1986

[86] PCT No.: PCT/AU86/00262

§ 371 Date: Jul. 15, 1987

§ 102(e) Date: Jul. 15, 1987

[87] PCT Pub. No.: WO87/02554

PCT Pub. Date: May 7, 1987

[30] Foreign Application Priority Data

Oct. 25, 1985 [AU] Australia ..... PH03148

[51] Int. Cl.[4] ..... A45C 9/00; A45C 15/00

[52] U.S. Cl. ..... 190/1; 190/2; 190/109; 190/111; 150/106; 150/117; 206/545; 383/4; 224/151; 5/420

[58] Field of Search ..... 190/1, 2, 107, 111, 190/109; 383/4, 38–40; 206/545; 150/106, 117; 224/151, 156; 5/417, 420

[56] References Cited

U.S. PATENT DOCUMENTS

| | | | |
|---|---|---|---|
| 535,365 | 3/1895 | Fadner | 190/2 |
| 1,176,598 | 3/1916 | Pollgreen | 190/111 |
| 2,718,447 | 9/1955 | Wright | 220/6 X |
| 2,844,141 | 7/1958 | Daugherty | 190/111 X |
| 3,052,895 | 9/1962 | Lo Vico | 383/4 X |
| 3,489,194 | 1/1970 | Hoover | 190/2 X |
| 4,068,786 | 1/1978 | Taniguchi | 190/2 X |
| 4,154,323 | 5/1979 | Sneider | 383/4 X |
| 4,164,275 | 8/1979 | Davis | 190/2 |
| 4,483,469 | 11/1984 | Arisland | 190/107 |
| 4,566,130 | 1/1986 | Coates | 190/1 X |

FOREIGN PATENT DOCUMENTS

| | | | |
|---|---|---|---|
| 1452648 | 9/1966 | France | 190/111 |
| 2478972 | 10/1981 | France | 190/1 |
| 2507454 | 12/1982 | France | 190/2 |
| 2054388 | 2/1981 | United Kingdom | 190/1 |
| 2061712 | 5/1981 | United Kingdom | 190/2 |

*Primary Examiner*—William Price
*Assistant Examiner*—Sue A. Weaver
*Attorney, Agent, or Firm*—Dellett, Smith-Hill & Bedell

[57] ABSTRACT

A nappy or diaper changing bag is made from a soft quilted plastic material and comprises two closable storage compartments connected at their undersides by a mat on which the baby being changed is placed. Foldable end flaps support the baby's head and legs, respectively. Nappies or diapers and ointments can be stored in the compartments and feeding bottles in wells provided in the end of one of the compartments. During transportation of the bag, the flaps are folded over the mat and one compartment is placed over the other compartment and held in place by fastenings. Handles attached to the lower part of the bag enable it to be carried.

5 Claims, 3 Drawing Sheets

NAPPY OR DIAPER CHANGING BAG

FIELD OF THE INVENTION

This invention relates to a nappy changing bag.

STATE OF THE ART

Currently-available nappy changing bags comprise a small sack closable by a draw-string and having a number of external pockets. Spare disposable nappies and liners are carried in the sack and ointments and talcum powder containers can be fitted into the external pockets.

OBJECT OF THE INVENTION

An object of this invention is to provide a nappy changing bag able to provide a mat on which the baby is rested during changing, as well as hold the various items necessary to carry out a nappy-changing operation.

SUMMARY OF THE INVENTION

A nappy changing bag, in accordance with the present invention, comprises two spaced compartments, a flexible mat having one pair of opposed edges respectively attached to the lower portions of the two compartments, means for holding the two compartments together with the mat folded between them and both compartments upright when the bag is being carried, and handles for carrying the bag.

PREFERRED FEATURES OF THE INVENTION

Preferably the mat has extension flaps at each end which, when the bag is folded up, are folded over the portion of the mat spanning between the two compartments. When the bag is unfolded, the flaps lie respectively under the baby's head and legs.

Suitably the width of the mat spanning between the two compartments is sufficient to be folded up one side and over the top of one of the compartments which provides the lower compartment when the bag is in its folded state. The two compartments thus remain upright when the bag is folded so that there is no danger of their contents spilling when the bag is being carried from place-to-place.

Conveniently the lower of the two compartments is provided with an external end chamber containing a block of a heat-insulating material provided with upright storage wells into which feeding bottles can be placed and which will therefore remain warm for an extended period.

Although it is preferred to have the compartments arranged one above the other when the bag is folded, it is within the spirit of the invention to arrange the handles as running loops extending through holding loops on the two compartments so that the two compartments can be drawn together horizontally with the mat folded between them. End fasteners, for example, may also be used to hold the two compartments together in addition to the handles. Alternatively, the handles may be attached to the respective compartments and the end fasteners alone used to hold the compartments together with the mat folded between them.

The invention will now be described in more detail, by way of example, with reference to the accompanying diagrammatic drawings, in which:

IN THE DRAWINGS

DESCRIPTION OF THE PREFERRED EMBODIMENT

Figure 1:
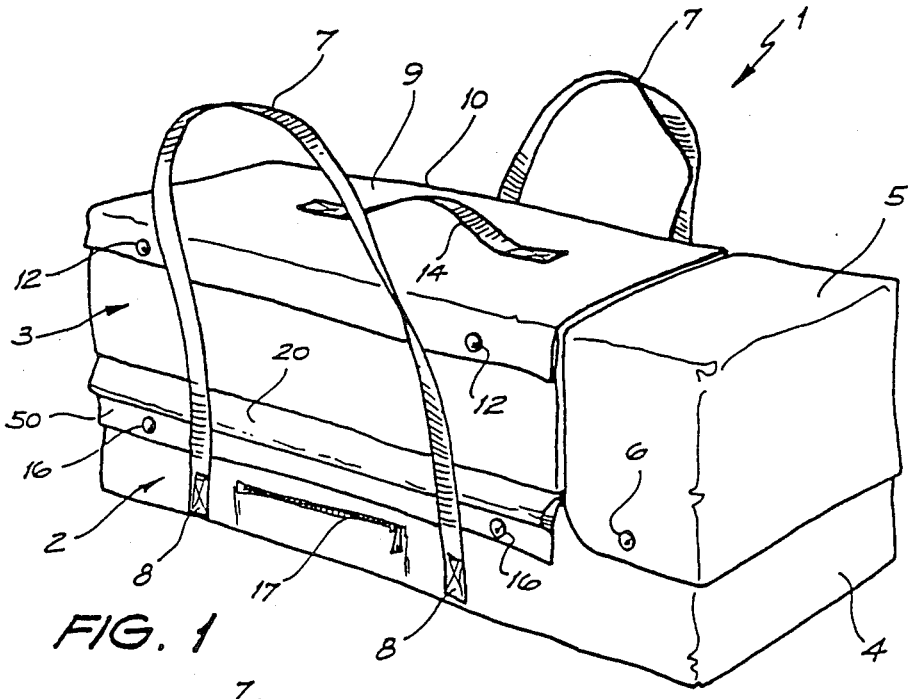
FIG. 1 is a perspective view from one side of a folded up nappy changing bag.
Figure 2:
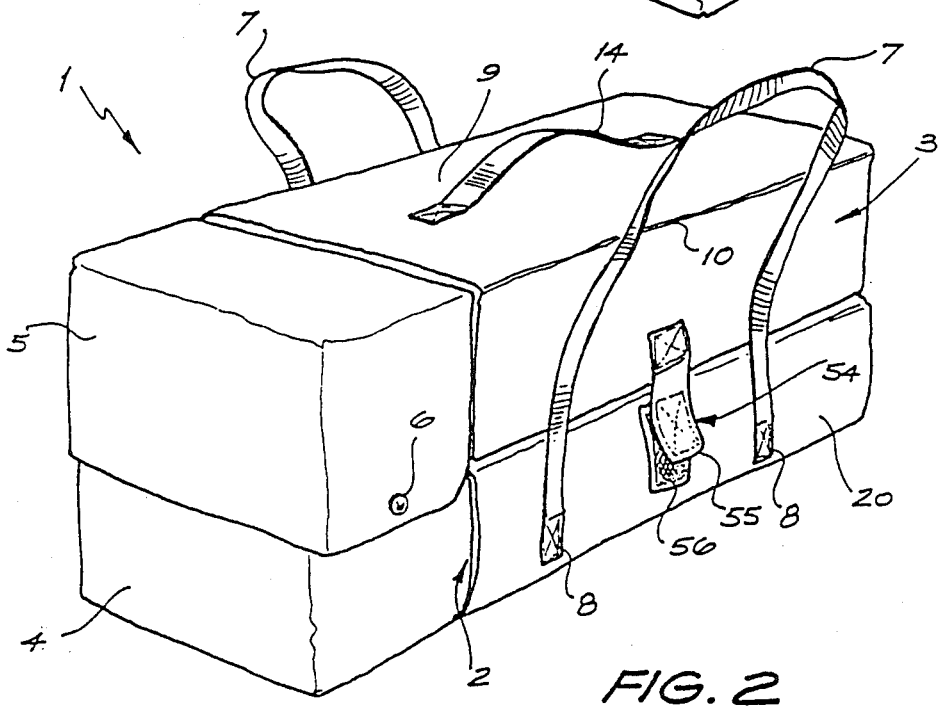
FIG. 2 is a perspective view of the other side of the bag of FIG. 1.

FIGS. 1 and 2 show a nappy changing bag 1 made of soft padded plastics material and providing two separate parallepiped compartments 2 and 3 arranged one above the other. The lower compartment 2 has an external chamber 4 provided with a removable lid 5 held in place by a pair of spaced press studs 6.

A pair of cloth carrying handles are stitched at 8 to the lower opposite sides of the bag 1 to enable the bag to easily carried in one hand by handles 7.

A lid 9 is hinged along one edge 10 to the upper side of the upper compartment 3 and is held closed by a pair of press studs 12. A strap handle 14 is provided on the top of the lid 9.

Figure 3:
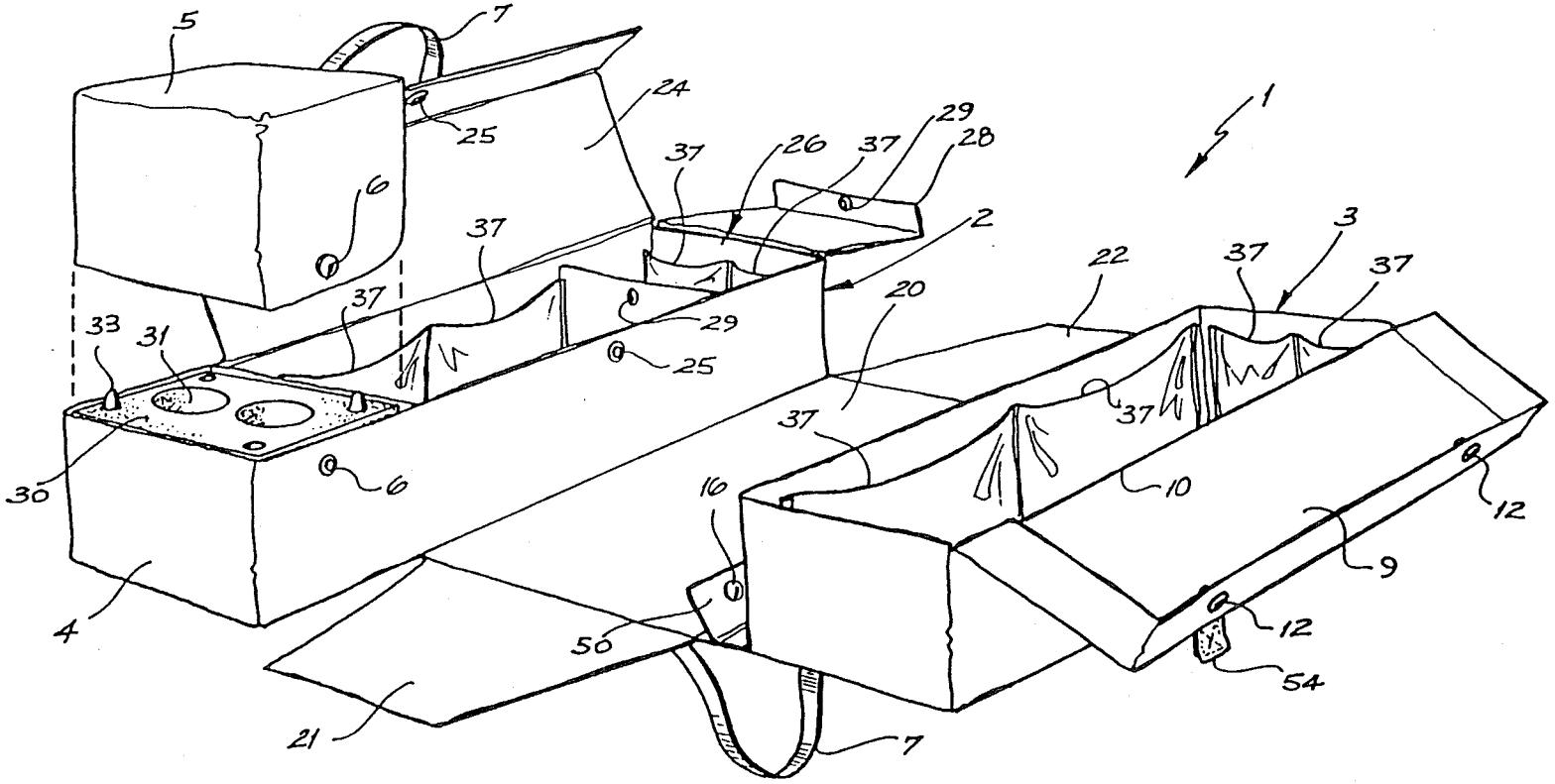
FIG. 3 shows the bag opened out and partially exploded.

FIG. 3 shows the bag 1 unfolded on a level surface with the two compartments 2 and 3 open. Spanning between the compartments is a central portion of a padded mat 20 on which the baby being changed is placed. The mat 20 has extension flaps 21 and 22 at opposite ends which are folded over the central portion of the mat when the bag is in its folded up state. The lower compartment 2 is provided with a lid 24 held closed by press stud fastenings 25. The compartment 2 has an integral sub-compartment 26 at its end remote from the chamber 4. Side pouches 37 are provided in the compartments 2,3 and 26, as shown. Compartment 26 has a lid 28 held down by press stud fastenings 29.

Figure 4:
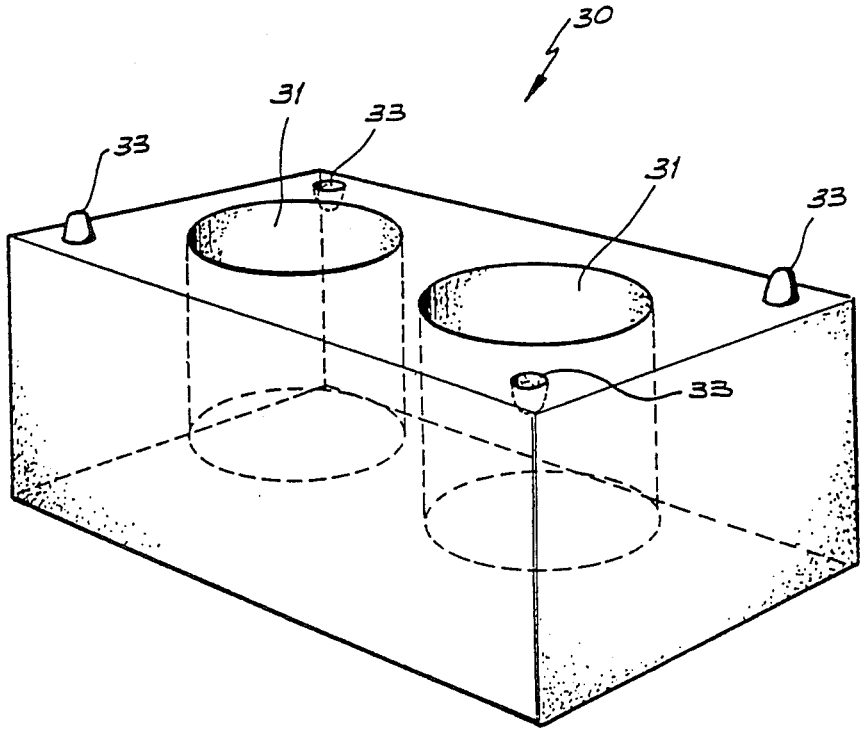
FIG. 4 is a perspective view from above of a foam plastics block used as an insert in an end-compartment of the bag.

The chamber 4 and its lid 5 each contain a block of foam plastics material 30, of the shape shown in FIG. 4, fitted into them. The blocks 30 have registering wells 31 for receiving two baby feeding bottles (not shown) respectively. As foamed plastics material is a good thermal insulator, the blocks keep the bottles warm for a prolonged period. Interengaging dowels and sockets 33 in the blocks 30 enable them to locate together when the lid 5 is fitted onto the chamber 4.

An edge strip 50 equipped on its underside with two press stud fastenings 16 is provided at one side of the mat 20 and is attached to the mat 20 adjacent the compartment 3. Complementary press stud fastenings (not shown) are provided on the upper portion of one side of the compartment 2 . A central tongue 54 is provided on the lower outside edge of the upper compartment, and its underside is faced with a rip-fastening material such as that commercially available under the registered trade mark "VELCRO" and identified on the figure at 55. A complementary fastening strip 56 is provided on the underside of the mat 20 so that, when the mat is folded over, the top of the lower compartment 2, the two complementary fastening strips 55 and 56 can be engaged with one another to hold down the side of the upper compartment 3 on which the lid 9 is hinged. In consequence, the two compartments are held on one another when in their stacked position shown in FIGS. 1 and 2, by the tongue 54 and the strip 50.

OPERATION OF THE PREFERRED EMBODIMENT

The bag is laid out as shown in FIG. 3 and the various items, such as nappy liners, pads, medications and so forth as required for a nappy change, are placed in the compartments 2,3 and 26 which are then closed. If feeding bottles are required, two of these can be carried in the wells 31.

The bag 1 is folded up to the state shown in FIGS. 1 and 2 by first folding the flaps 21,22 over the central portion of the mat 20 which has a width larger than the height plus the width of the lower compartment 2. The upper compartment 3 is then lifted up by the handle 14, and placed over the lower compartment 2 so that the mat 20 is folded up the side and over the top of the lower compartment 2 as shown in FIG. 1 and 2. The press studs 16 are engaged on the complimentary studs to hold the surplus mat in an external fold as shown in FIG. 1.

Finally the lid 5 is placed on the chamber 4 and held in place by the press studs 6. The tongue 54 is fastened to the folded mat 20 by engagement of the complementary fastening strips 55 and 56.

A typical example of the above-described bag had the following dimensions:

Widths of compartments 2 and 3: 17 centimeters.
Depths of compartments 2 and 3: 13.5 centimeters.
Lengths of compartments 2 and 3: 31 centimeters
Width of mat 20: 40 centimeters.
Length of head flap 21: 19 centimeters.
Length of feet flap 22: 28 centimeters.
Length of chamber 4: 8 centimeters.

Although the nappy bag described is made of soft padded plastics material, other materials such as cloth or even leather could also be used for all or parts of the bag. Also, in places where press stud fasteners have been described, rip fasteners of the VELCRO type or other forms of fasteners may equally well be used. Finally, the lid 24 of the lower compartment 2 may be dispensed with to make the bag cheaper, as the folding of the mat 20 over the lower compartment when the bag is in its transport mode effectively provides a cover for the lower compartment.

It may be convenient to provide an externally accessible pocket for items not related to the nappy change. Such a pocket, closed by a zip fastener 17, is shown in FIG. 1.

I claim:

1. A nappy changing bag, comprising two spaced compartments, a flexible mat having one pair of opposed edges respectively attached to the lower portions of the two compartments, means for holding the two compartments together with the mat folded between them and both compartments upright when the bag is being carried, and handles for carrying the bag.

2. A bag as claimed in claim 1, in which the bag folds up by placing one of the compartments on top of the other, and the width of the mat spanning between the two compartments is equal to at least the height plus the width of the lower compartment.

3. A bag as claimed in claim 2, in which two carrier handles are provided respectively at opposite sides of the bag and are attached to opposite sides of its lower portion respectively.

4. A bag as claimed in claim 3, in which the mat has end-flaps which fold over the portion spanning between the two compartments prior to folding up the bag.

5. A bag as claimed in claim 2, including a storage chamber at one end of one of the compartments and separated therefrom by a partition, the chamber containing a block of thermally insulative material having a well for receiving a feeding bottle.

* * * * *